US006076331A

United States Patent [19]

Granbakken et al.

[11] Patent Number: 6,076,331

[45] Date of Patent: Jun. 20, 2000

[54] METHOD OF PACKAGING TOGETHER SERIES OF CONTAINERS, PARTICULARLY BOTTLES, AS WELL AS A DEVICE AND A HOLDER DESIGNED TO CARRY OUT THE METHOD

[75] Inventors: Tore Granbakken; Erik Harald Skogly, both of Hokksund; Finn R. Hansen, Hønefoss, all of Norway

[73] Assignee: Dalwell AB, Backefors, Sweden

[21] Appl. No.: 09/068,855

[22] PCT Filed: Nov. 20, 1996

[86] PCT No.: PCT/SE96/01515

§ 371 Date: May 19, 1998

§ 102(e) Date: May 19, 1998

[87] PCT Pub. No.: WO97/18993

PCT Pub. Date: May 29, 1997

[30] Foreign Application Priority Data

Nov. 20, 1995 [SE] Sweden ..... 9504161

[51] Int. Cl.[7] ..... B65B 21/00

[52] U.S. Cl. ..... 53/398; 53/48.1

[58] Field of Search ..... 53/398, 48.1, 48.8, 53/48.9

[56] References Cited

U.S. PATENT DOCUMENTS

| | | | |
|---|---|---|---|
| 3,070,928 | 1/1963 | Ganz | 53/48.9 X |
| 3,085,377 | 4/1963 | Ganz | 53/398 |
| 3,302,364 | 2/1967 | Rice | 53/398 |
| 3,383,827 | 5/1968 | Schiach | 53/398 |
| 4,121,401 | 10/1978 | Duerr et al. | 53/398 |
| 4,499,704 | 2/1985 | Bacon et al. | 53/48.8 |

FOREIGN PATENT DOCUMENTS

| | | |
|---|---|---|
| 0255337 | 2/1988 | European Pat. Off. . |
| 0150944 | 8/1995 | European Pat. Off. . |
| 2138409 | 1/1973 | France . |
| 127963 | 9/1973 | Norway . |
| 356479 | 5/1973 | Sweden . |
| 2202509 | 9/1988 | United Kingdom . |
| 9302941 | 2/1993 | WIPO . |
| 9426594 | 11/1994 | WIPO . |

*Primary Examiner*—Linda Johnson
*Attorney, Agent, or Firm*—Davis and Bujold

[57] ABSTRACT

The invention relates to a method of packaging together series of bottles (6) by holder blanks (4) in which each one is to hold a number of bottles. The holder blanks (4) are provided in stacks (8) and are fed via a separation unit (9) to an application unit (3), into which bottles are fed on a conveyor (5) in a required formation (27). When a holder blank is applied, its laterally disposed flaps (39) are bent downwards and, at the same time, fingers (44), integrated with the flaps and possibly additional fingers are pressed upwards by the bottle caps (26) and the bottle flanges (26), respectively, and are moved downwards below their level. At the same time, the holder blank is cut through to obtain individual holders to rows of holders. The invention also relates to a device (1) designed to carry out this method and a holder (4), to be used when carrying out the method and with the device (1), respectively.

20 Claims, 5 Drawing Sheets

METHOD OF PACKAGING TOGETHER SERIES OF CONTAINERS, PARTICULARLY BOTTLES, AS WELL AS A DEVICE AND A HOLDER DESIGNED TO CARRY OUT THE METHOD

The present invention relates to a method of packaging together series of containers, particularly bottles. The invention also relates to a device designed to carry out the method. The invention also relates to a holder, which is used when carrying out the method according to the preamble of the first claim, which relates to such a holder.

BACKGROUND OF THE INVENTION

As an alternative to boxes and crates particularly disposable holders for series of bottles have become customary in recent years. Such disposable holders consist of a blank provided with punchings and perforations and groovings respectively, possibly a folded blank made of particularly cardboard or corrugated cardboard and package together e.g. 2, 3, 4 or 6 bottles to be shipped from the producer or the distributor to the consumers.

It is true that such holders generally are adapted to their purpose and advantageous, but in certain cases strength and fatigue problems respectively do still arise, particularly in case it is desirable to combine minimal use of material with a maximal number of bottles, which accounts for a substantial total weight.

Another problem or at least a wish exists primarily among the producers, i.e. a simultaneous packaging together and handling of a maximal number of bottles, which is quick, reliable and economic. Special machine elements and special machine operations have been required so far in order to bring every part of a holder into the appropriate locking position. The machine equipment is often complicated and expensive and the application process slow and not entirely reliable.

Examples of already known holders and machine equipment designed to apply them onto containers are described in WO-9302941, EP-A3-150 944, NO-B127 963 and SE-B-356 479. The subject of the last document is extremely simple and has no special gripping means. The subject of the Norwegian document is limited to a continuous single-row-formation of container cans with a bead. An exact synchronization of the mutual position of the containers and the application elements is necessary for a functioning process. The fit and the tolerances have to be precise. The holder probably is not generally suitable for bottles and absolutely not for bottles having varying shapes. No special gripping means are used. The European patent document relates to an application of three-dimensionally shaped fairly complicated containers, which nevertheless have no locking means. The PCT document relates to a folding of a relatively complicated holder blank according to FIG. 1 into a shape shown in FIG. 2 with gluing, after which containers can be introduced in a way not described in detail. This is of course time consuming and does not allow a use of fast mechanical application equipment, and also, the reliability of the holders can be questioned. Special gripping means are not used in this case either.

SUMMARY OF THE INVENTION

The object of the present invention is to solve these problems, to counter-act them and to eliminate them as much as possible. Another object of the invention is also to develop the state of the art in this field in various respects.

Still another object of the invention is to develop the use of safety and holding devices and vice versa in order to achieve a particularly fast and reliable application of holders onto a holder series formation. Another object is to be able to use in a very reliable way the same holders and the same equipment for different holder shapes and sizes.

These objects are attained according to the present invention by using a method of the type described in the introductory part of this text. Said objects are attained according to the invention also by means of a device of the type described in the introduction. Finally, said objects are attained according to the invention also by means of a holder of the type described in the introduction.

BRIEF DESCRIPTION OF THE DRAWINGS

Additional characterizing features and advantages of the present invention are set forth in the following description, reference being made to the enclosed drawings, which show a few preferred but not limiting embodiments. The drawings show in detail.

DESCRIPTION OF THE PREFERRED EMBODIMENTS

Figure 1:
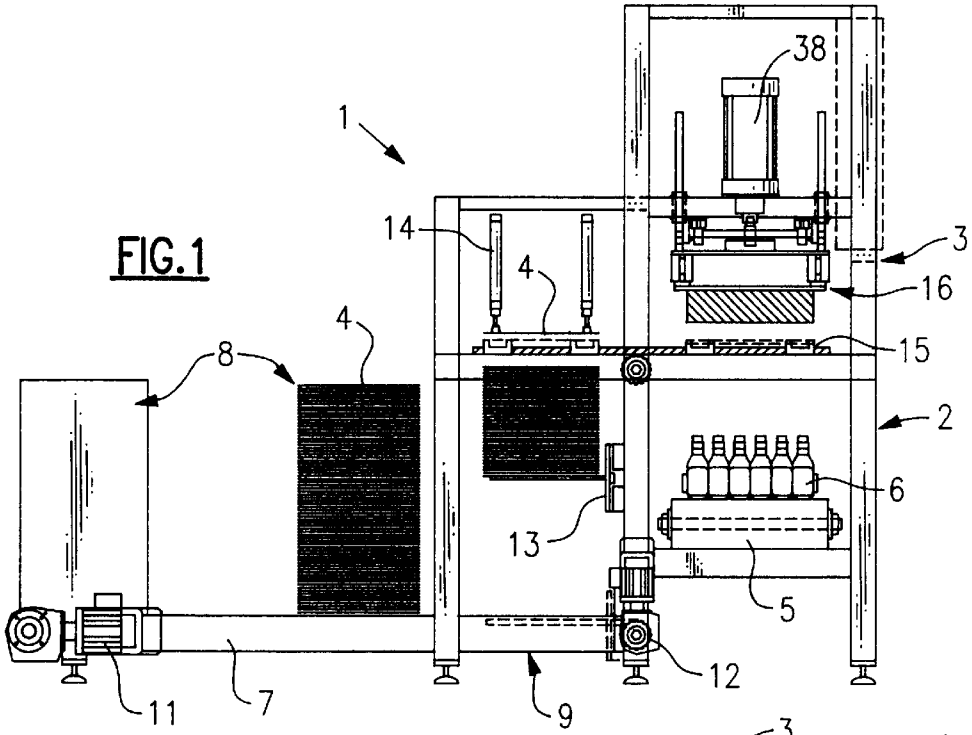
FIG. 1 a lateral view of a device according to the invention in a phase before the application of a holder according to the invention onto a series of bottles.

A device 1 according to the present invention is shown in its entirety in FIG. 1. The device comprises a machine frame 2 with a unit 3, designed to apply holder blanks 4 and shown in its entirety. A conveyor 5 is attached to the machine frame 2 and designed to feed containers 6, particularly bottles, which are to be packed together, and possibly to remove a series of bottles packed together in this way.

A storage and feeding conveyor 7 for holder blanks is attached to machine frame 2 in a perpendicular direction towards bottle conveyor 5, which blanks are stored in several stacks 8, of which the one, which is placed adjacent machine frame 2 is arranged in a separation unit 9, designed to feed separate blanks or sheets forming holders according to the invention into application unit 3 in mounting condition.

Figure 3:
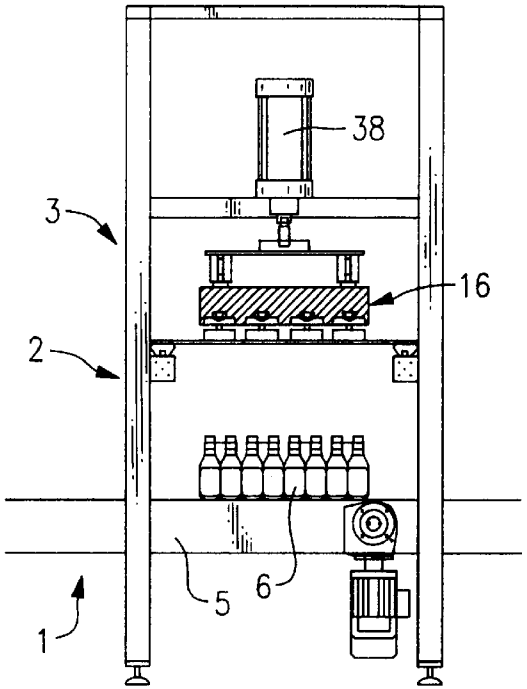
FIG. 3 a view from the left in FIG. 1 in a phase after the application of a holder according to the invention.
Figure 2:
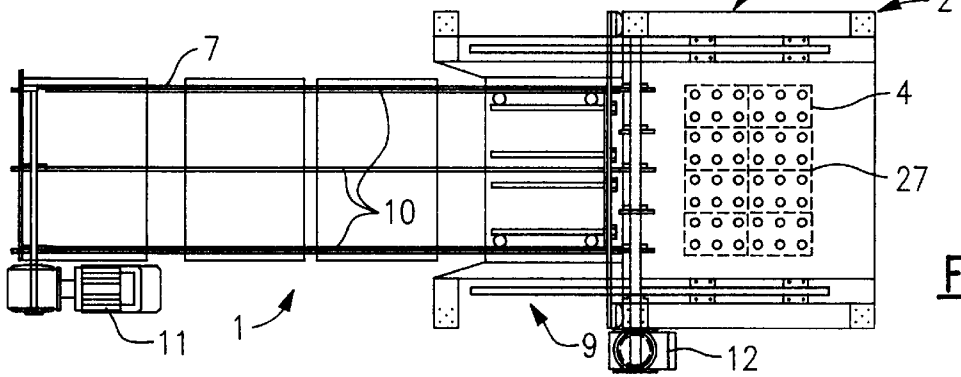
FIG. 2 a top view of the device according to FIG. 1.
Figure 4:
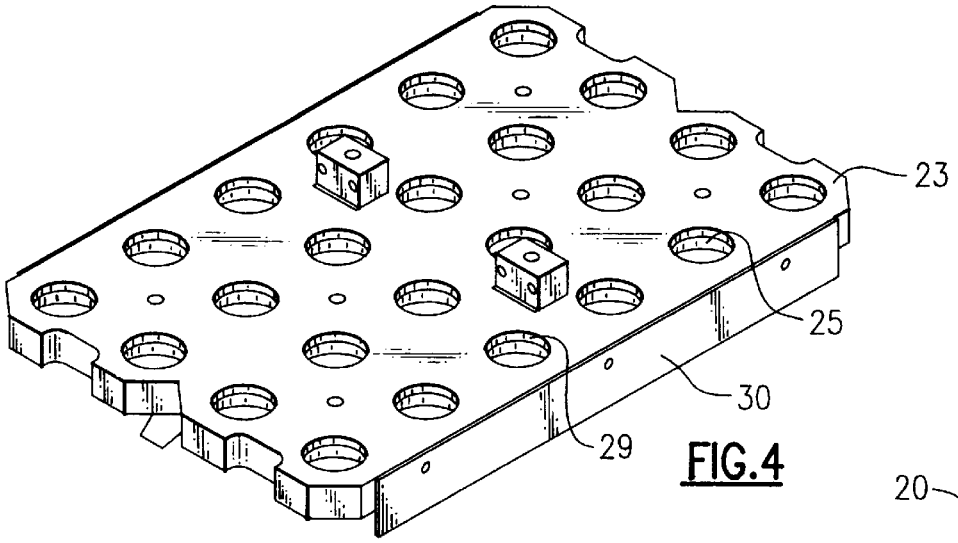
FIG. 4 a perspective top view of a multiple function plate according to the invention.
Figure 5:
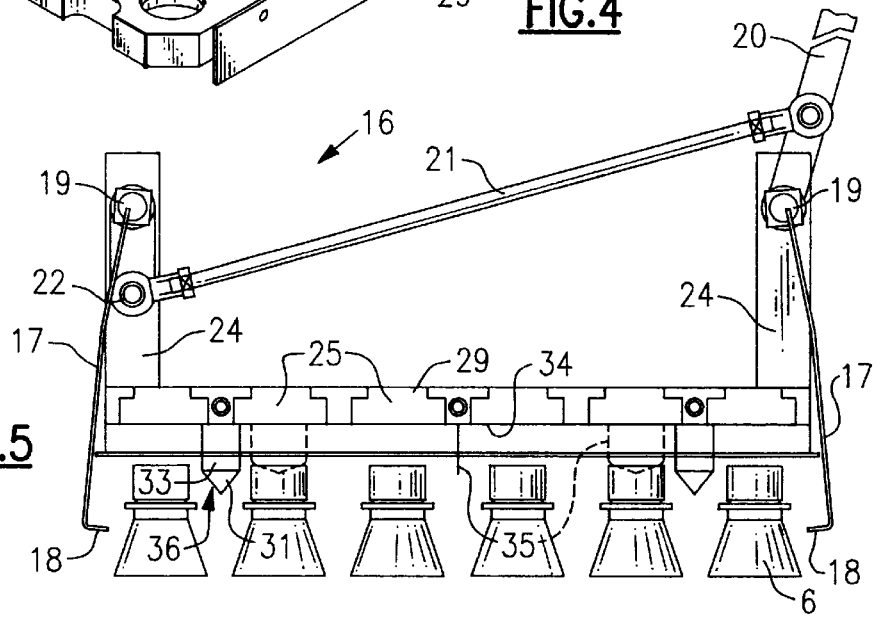
FIG. 5 a lateral view of a multiple function unit according to the invention.

It is shown in FIGS. 1, 2 and 3, that a certain number of bottles is fed, in this case 8×6 bottles for 8 packs and holders with 6 bottles in each respectively, 6 bottles for a total of 2 packs e.g. being arranged close to each other transversely to the conveyor and 8 bottles for a total of 4 packs in the longitudinal direction of the conveyor.

The feeding conveyor 7 comprises e.g. three endless chains or the like 10, driven by an electric motor 11, which can be switched on manually, when required, or mechanically during automatic operation.

Separation unit 9 is driven by an electric motor 12, which drives a feeding device 13, similar to an elevator, designed to successively lift the carried stack 8 to a working level for e.g. six pneumatically functioning suction devices 14, designed to separate and lift a holder blank and transfer it to a transfer device 15, designed to transfer it in a horisontal direction centrally into application unit 3 and in this position into a multi-functional unit 16, which has lateral carrying hooks 17, which in their lower part have bent horisontal surfaces 18, turned towards each other, for the lateral edges of the holder blank, and which in their upper parts are rotatably fastened to two pivots 19 in such a way, that simultaneous movements of the pivots with opposite swinging movements are possible, e.g. by fixedly attaching a control arm 20 to one of said pivots, from which arm in its turn a swingably attached transfer arm 21 issues, which via a joint or the like 22 influences carrying hook 17, attached to the other one of said pivots, or said second pivot via an arm (not shown), e.g. swingably attached to said second pivot. In this way the two hooks 17 and their bent surfaces 18 perform separating movements, when control arm 20 is rotated counter-clockwise according to FIG. 7 and when they are rotated counter-clockwise towards each other. In the latter case a holder blank can be seized and held. In the former case the blank can be lowered onto a series of bottles according to FIGS. 1 and 2.

Figure 7:
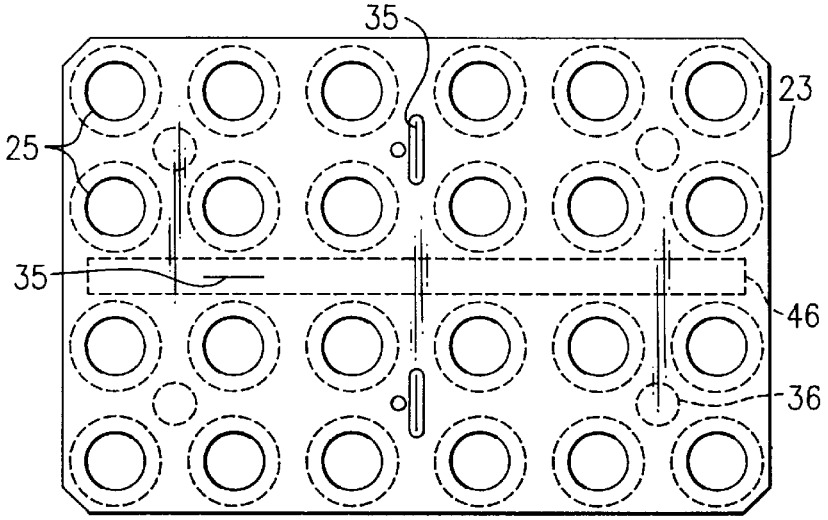
FIG. 7 a top view of a plate, which constitutes a part of a multiple function unit according to FIGS. 1–6.
Figure 9:
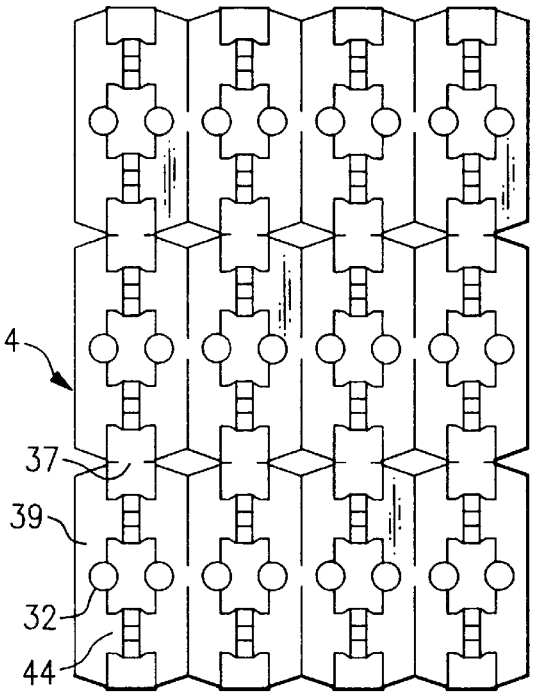
FIGS. 8–18 top views of blanks, designed for various holders according to the invention.
Figure 8:
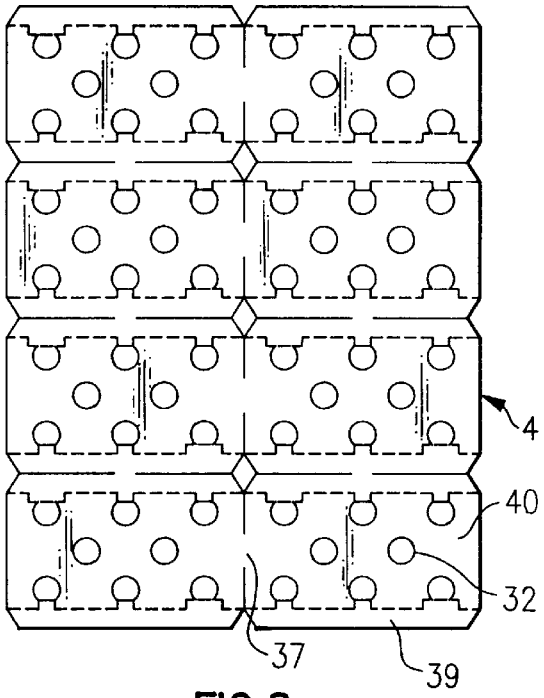
Figure 10:
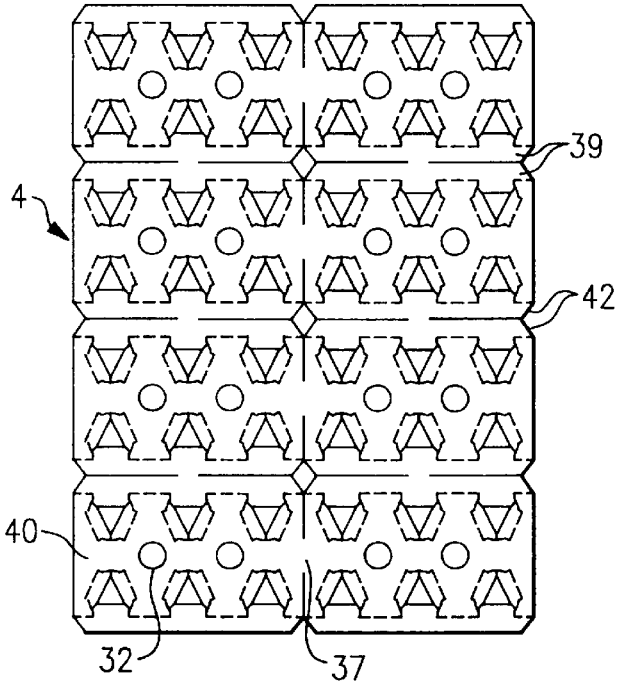
Figure 11:
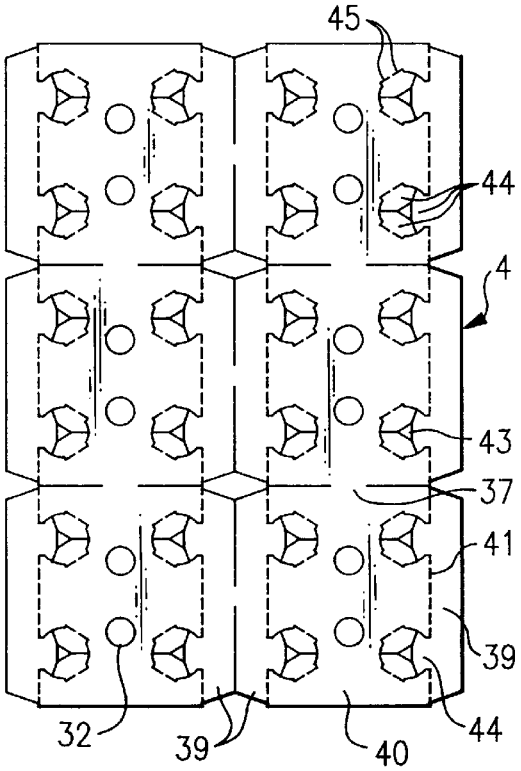
Figure 13:
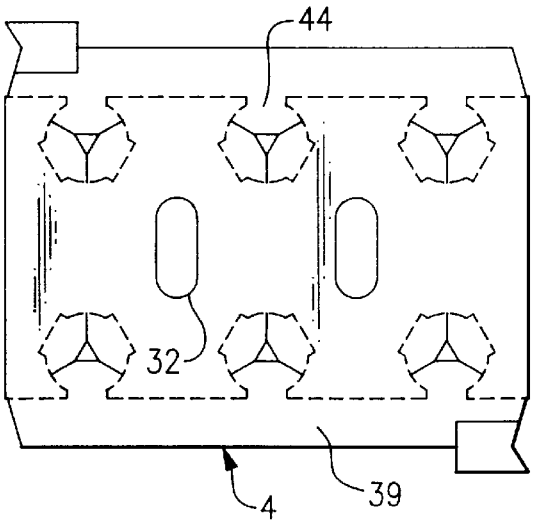
Figure 12:
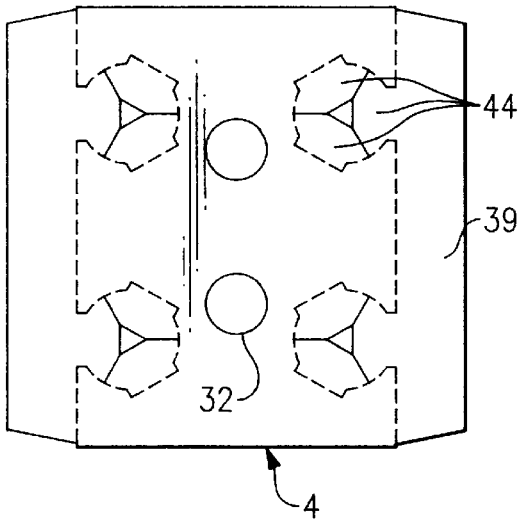
Figure 14:
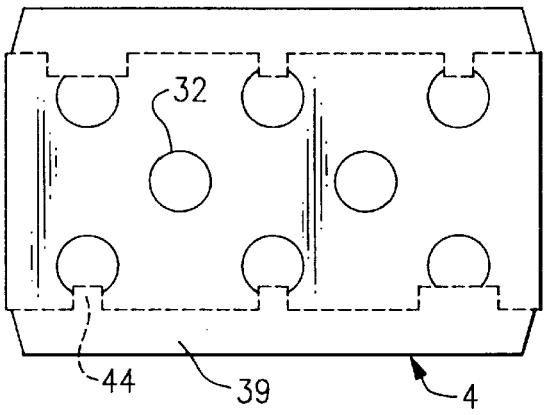
Figure 15:
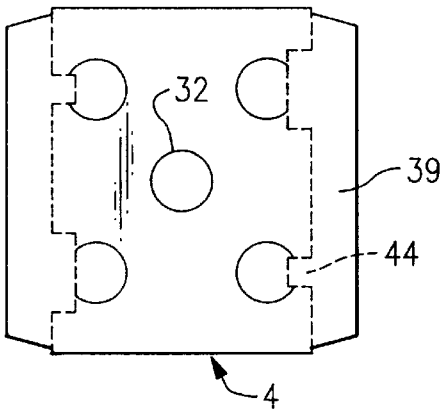
Figure 16:
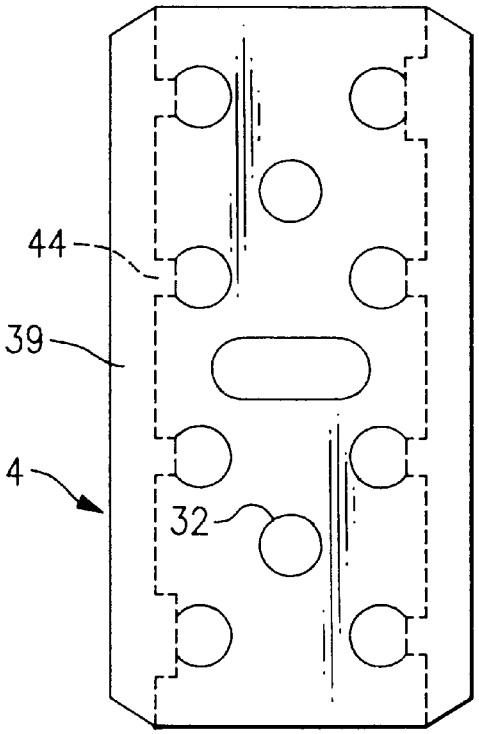
Figure 17:
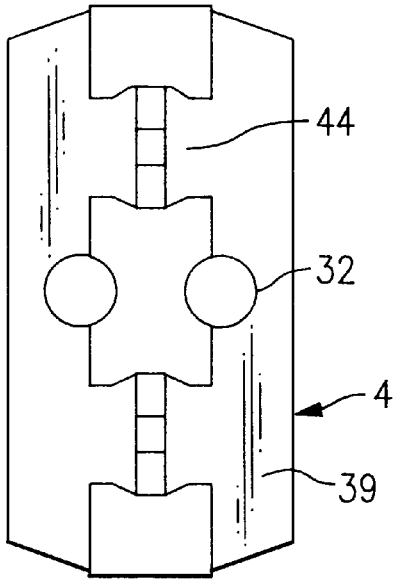
Figure 18:
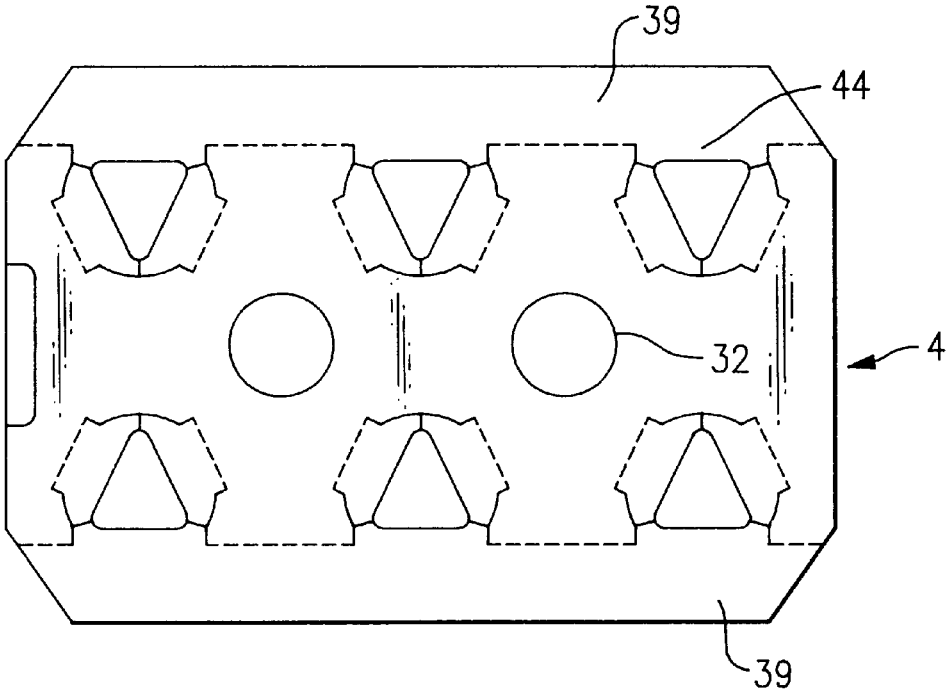

As depicted in FIG. 7 a horisontal multiple function plate 23 is positioned between bent surfaces 18 and pivots 19, which plate preferably is fastened to the lower ends of columns 24, which in their upper parts carry pivots 19. This plate is replaceable and has a pattern of vertical, preferably through holes 25, designed to be pressed downwards over e.g. screw caps 26 on bottles 6, arranged on assembly line 5. The bottles preferably also have a flange 28 below the cap and the holes in the plate are, particularly in this case, designed with a stop or an upper constriction 29, which will allow the caps to pierce the upper more narrow hole section but not the flanges. The hole pattern corresponds to bottle series formation 27 on assembly line 5.

Adjacent e.g. the two short sides of the plate said carrying hooks 17 are positioned, whereas along the two long sides of the plate fastened folding flanges 30 extend. These folding flanges project downwards over the plate and their width are e.g. the same as the thickness of the plate. On the lower face 34 of the plate there are e.g. two downwardly projecting positioning pins 36, which preferably are mutually diagonally arranged. Free ends 31 of the pins preferably are cone-shaped and designed to be able to pierce grip holes 32 (described in the following text) in a holder blank. Bases 33 of the pins preferably are cylindrical and has a diameter, which roughly corresponds to the diameter of said holes. Also, a number of knives 35 are fastened to the lower face of the plate, which are positioned exactly above bridges 37 in a holder blank and designed to cut through these bridges, in order to divide up the holder blank into separate holders, which will pack together a series of bottles. Said knives can of course be left out partly, in case the purpose is to keep together a row of two, three or four holders having the same number of series of bottles.

Multiple function unit 16 is positioned below a hydraulic or pneumatic press cylinder 38 with an associated equipment in the application unit and is moved up and down by means of the press cylinder. A lateral displacement can possibly also be used, in case a small multiple function plate is to pack together a large number of bottles without moving the bottles. Said equipment comprises of course elements etc. designed to regulate the cylinder stroke and to adjust the plate in the longitudinal and lateral directions etc. Finally, the invention relates to a particularly designed holder blank according to FIGS. 8–18. Each holder blank 4, which preferably is made of corrugated cardboard preferably comprises several, e.g. two, four, six or eight separate holders, which are kept together by means of bridges 37, alternatively perforations or the like. Each holder has flaps 39, arranged on at least two mutually opposite sides, which are marked off from main area 40 of the blank by means of e.g. a perforation line 41. Narrow sides 42 of the flaps preferably are oblique. Two through grip holes 32 are arranged in the blanks, perpendicular to it, e.g. roughly centrally located in it and designed to be used, when a packed together series of bottles is to be carried by a person, by inserting fingers in the grip holes. A number of locking holes 43 are distributed in a suitable fashion along the main area of the blank and corresponds to the number of bottles in a packed together series thereof. Holes 43 are surrounded all around or on only one or two sides by locking fingers 44 according to the drawings. One of said fingers is connected to the adjacent flap, whereas the rest of them, if any, are marked off from the main area via perforations 45. The corrugations in the cardboard in this case preferably are arranged perpendicular to the flaps and thus extend in the longitudinal direction of said one finger, a stiffening av the finger being obtained. It is suitable to use only two additional fingers, each of which extends around ⅓ of the periphery. In this way the corrugations in the cardboard material will not in any finger run perpendicular thereto, which means that none of the fingers can be easily broken around a corrugation formation in the material. The design of the various holder blanks, flaps, holes, fingers etc. is clearly shown in the drawings.

Figure 6:
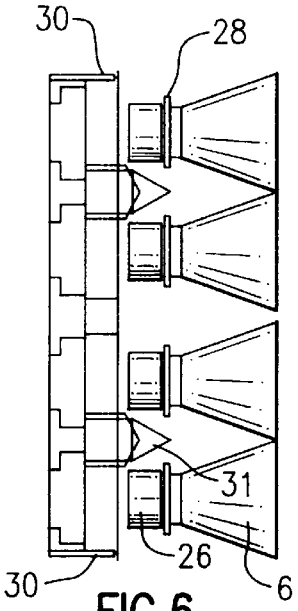
FIG. 6 a lateral view in detail of a phase just before the application of a holder according to the invention onto a series of bottles.

The mode of operation according to the invention is as follows: When the bottles are fed on bottle conveyor 5, preferably without spaces between them or with such spaces, which correspond to desired formations, holder blank conveyor 7 is provided with packs 8 of holder blanks and such a pack is present in separation unit 9, in which suction devices 14 lift the uppermost blank from the pack and pass it to the transfer unit, to be transported to the application unit, in which the blank is seized by multiple function unit 16, which is lowered onto a bottle series formation. During this movement the blank is held and positioned by means of bent surfaces 18 along two mutually opposite sides, whereas the folding flanges are situated at a distance from the blank above the two other sides. When subsequently the blank collides wtih bottle caps 26 with its fingers still in the same plane as the main area, it substantially is stopped, while pins 31 in a position-locking way penetrate some grip holes and the knives soon thereafter cut through said bridges 37. This position is shown in FIGS. 6 and 7, in which the distance between the holder blank and the bottle caps solely has been chosen for the purpose of illustration. Subsequently the folding flanges collide with the blank and fold its flaps 39 downwards, at the same time as plate 23 contacts the holder blank around its locking holes and moves main area 40 past the bottle caps and possibly also bottle flanges 28. During this latter movement the fingers are folded upwards by means of the bottle caps and will slide past the latter och possibly the bottle flanges, the wider lower portion of plate holes 25 allowing such a folding upwards. Finally, the free end edges of the flaps end up below the bottle flanges and in some cases only the bottle caps respectively, a self-locking of the holder blank on the bottle series being obtained. Subsequently the multiple function unit can start its movement upwards again and recieve a new holder blank to be applied to one or several new bottle series. It is to be particularly noted, that the fingers, which are integrated with the flaps obtain an extension thanks to the flaps, which are retained by means of the fingers, the main area becoming stiffer and its bending being counter-acted, since the flaps are arranged at an angle of e.g. roughly 80° in relation to the main area. Also, the described application of a holder blank onto the bottles is very careful or cautious with all the parts, since e.g. the deflecting influence of the folding flanges on the flaps corresponds to the lifting of the fingers by means of the bottle caps. Thus, these two different folding and holder functional form-creating means assist each other, which to a high degree guarantees, that disadvantageous foldings, e.g. in inappropriate locations or where the material is thinner and for other reasons are prevented.

It is easy and simple to replace the multiple function plates with other plates and this can be done quickly, in case a new type of bottle is to be packed. Also, the rest of the parts can quickly be adjusted to changed operation conditions, client preferences etc. As can be seen, there are differently designed holder blanks available, which however all have a common characteristic: fingers integrated with the flaps and/or several holders fastened to each other via bridges in the same blank.

In case very wide flaps are required, then it is possible either to temporarily position the bottles in the application unit at a certain mutual distance, so that the locking holes, despite the wider flaps, will end up just above the bottle caps or to just before or in connection with the application of the holder blank fold the inner flaps fully or partly in order to position the locking holes just above the bottle caps. This folding may be carried out e.g. by early pressing the knives and/or projections against the blank. On the whole a barrier or some other type of projection 46 can, within the area for the inner flaps, like the folding flanges, be pressed against the flaps in the blank and bend them downwards into the required useful shape, which preferably is done simultaneuos with the cutting of the holder blank into individual holders. Also, the flaps can at their free ends be provided with e.g. inward bends, designed to hold a portion of the bottle neck.

In connection with FIGS. 6 and 7 it should be noted, that either the carrying hooks can be actively moved aside, when the holder blank is pressed against the bottle caps and during the ensuing continued movement downwards of the multiple function unit or the downwardly and outwardly diverging carrying hooks can be passively moved aside due to translational movements, caused by the holder blank, of the described and shown mechanism, which via arm 20 e.g. can stop the movement downwards of the unit and initiate said movements upwards. What has been described can of course be integrated into one appropriate automatic mechanism.

It is also possible to design the outer flaps with such a very large length perpendicular to the main area, possibly perforations etc., that such a flap can be folded around all the series of bottles and be connected to the shorter flap on the other side of the series.

The invention is not limited to what has been described above and as to the embodiments shown in the enclosed drawings, but it can be modified and supplemented in an arbitrary manner within the scope of the inventive idea and the enclosed patent claims.

What is claimed is:

1. A method of packaging together a plurality of containers (6), each having a cap (26) and a neck flange (28), via a holder blank (4) comprising foldable side flaps (39) and a plurality of perforations forming flexible fingers defining a plurality of apertures for engaging with one of the plurality of containers, at least some of the flexible fingers being formed integral with and being simultaneously movable in a direction opposite to a direction of movement of the foldable side flaps (39), the method comprising the steps of:

providing a plurality of holder blanks;

stacking the plurality of holder blanks in a separation unit (9);

sequentially feeding a holder blank from the stacked plurality of holder blanks in the separation unit (9) to an application unit (3);

conveying the plurality of containers (6) in a desired arrangement (27), via a container conveyor, to a position in the application unit vertically below the sequentially fed holder blank;

causing relative vertical movement between the holder blank and the plurality of containers in the application unit to facilitate folding of the foldable side flaps (39) of the holder blank (4) vertically downward for contacting and at least partially encompassing an adjacent group of the plurality of containers while the flexible fingers, formed integral with the side flaps (39), simultaneously moving in an opposite vertically upward direction, and concurrently urging the holder blank vertically downward to allow each of the apertures to engage one of the plurality of containers in a desired arrangement (27) such that the remaining flexible fingers are biased vertically upward, as a result of contact with the cap and the neck flanges of the containers engaging with the apertures; and causing further relative vertical movement between the fed holder blank and the plurality of containers such that the fed holder blank is moved vertically below at least the caps of the plurality of containers to facilitate the flexible fingers elastically and independently springing into a locking position to captively engage at least one of the cap and neck flange of the plurality of containers.

2. The method of packaging together a plurality of containers (6) according to claim 1 wherein the application unit further comprises a multiple function unit which positions and carries the fed holder blank (4) via positioning pins (36) and a pair of opposed horizontal carrying surfaces (18), and the sequentially feeding step further comprising the steps of:

lowering the fed holder blank (4) into engagement with the plurality of containers (6);

cutting the holder blank (4) into a plurality of individual separate holders; and folding the flaps (39) of the individual holders vertically downward, via folding flanges, substantially encompassing the adjacent group of one plurality of containers and concurrently forcing the flexible fingers vertically upward to enable each respective cap and neck flange to pass through the respective aperture until the flexible fingers are allowed to spring into the locking position.

3. The method of packaging together a plurality of containers (6) according to claim 2, further comprising the steps of:

defining the side flaps (39) of the fed holder blanks (4) by discontinuous fold scores (41);

lowering, via the multiple function unit (16), the fed holder blank onto the desired arrangement (27);

folding the side flaps (39) vertically downward about the discontinuous fold score (41) and simultaneously bending the flexible fingers (44), integral with the side flaps, as a rigid unit upward and moving a free end edge of the flexible fingers to a level below a lower limitation of one of the caps and the neck flanges in order to subsequently, upon a returning upward movement, allow the flexible fingers to elastically and independently spring into the locking position below one of the caps and the neck flanges.

4. The method of packaging together a plurality of containers (6) according to claim 2 further comprising the steps of manipulating the holder blank using opposing lateral carrying hooks (17) of the multiple function unit (16) for supporting opposed lateral edges of the holder blank, each carrying hook having one of the pair of opposed horizontal surfaces, on a lower portion thereof, for supporting the holder blank, and an upper portion of the carrying hooks (17) is rotatably fastened to a pivot (19), the carrying hooks perform simultaneous mutually opposite rotational movements manipulated by a control arm (20) non-rotatably connected to the pivot of one of the carrying hooks, and the control arm rotatably influencing a movement transfer arm (21) non-rotatably connected to the other pivot of the opposed carrying hook (17).

5. The method of packaging together a plurality of containers (6) according to claim 4 further comprising the steps of arranging a horizontal multiple function plate (23), between the opposed horizontal surfaces (18) and the pivots (19) of the carrying hooks (17), fastening the horizontal multiple function plate (23) to a lower portion of a plurality of columns (24), supporting the pivots (19) on an upper portion of the columns, the plate being replaceable and having a pattern of vertical through holes (25), corresponding to the desired formation (27) of the plurality of containers on the container conveyor (5), designing the vertical through holes (25) to align with and be pressed vertically downward at least over the caps (26) of the plurality of containers (6), and providing the through holes with one of an upper step and a constriction (29) which allows the caps, but not the neck flanges of the container, to pass unobstructed through the through hole.

6. The method of packaging together a plurality of containers (6) according to claim 5 further comprising the steps of folding the side flaps of the fed holder blank by constructing the plate with opposing first and second short sides and opposing first and second long sides, the opposing carrying hooks (17) being arranged to support the fed holder blank adjacent the two short sides of the plate (23), and the folding flanges (30) being attached to and projecting downward from the plate, along the two long sides of the plate (23), the folding flanges having a width which is the same dimension as a thickness of the plate;

aligning the fed holder blank on the plate via at least two positioning pins (36) depending vertically downwardly from the plate, the at least two the positioning pins (36) are diagonally disposed, having a cone-shaped tip portion for piercing grip holes (32) in the fed holder blank (4), and cylindrical bases (33) with a diameter substantially the same as a diameter of the grip hole; and cutting the holder blank into a plurality of individual holders via a plurality of knives (35) depending vertically downwardly from the plate, the knives being aligned above bridges (37) of the fed holder blank for cutting through the bridges to separate the fed holder blank into the individual holders, and each individual holder engaging with a respective adjacent group of the plurality of containers (6) to produce a complete package of containers.

7. The method of packaging together a plurality of containers (6) according to claim 1 further comprising the steps of defining the apertures by punching holes and perforations in each holder blank to form the plurality of flexible fingers separated by the perforations and at least one flexible finger being formed integrally with the side flap while the remaining fingers being formed integral with a main area of the holder blank.

8. The method of packaging together a plurality of containers (6) according to claim 7 further comprising the steps of fabricating the holder blank (4) from corrugated cardboard and forming a plurality of individual holders connected to each other by bridges (37) defined by perforations, and each holder blank (4) having side flaps (39) on at least two mutually opposite sides, separating the side flaps from the main area (40) by one of a discontinuous perforation and a fold line (41), and forming two grip holes (32) in the main area of each of the plurality of individual holders of the holder blank (4).

9. The method of packaging together a plurality of containers (6) according to claim 8 further comprising the steps of:

forming, in the main area (40) of the holder blank (4), a number of holes corresponding to the number of containers to be engaged by the holder blank (4);

circumferentially delimiting each hole by three flexible fingers (44);

extending each flexible finger along about one third of a circumference of the hole, and forming one flexible finger integral with an adjacent side flap (39).

10. The method of packaging together a plurality of containers (6) according to claim 9 further comprising the steps of:

forming the side flaps (39) as wide flaps between laterally connected individual holder blanks (4);

folding the wide flaps into a folded configuration to facilitate engagement of the holder blank with the plurality of containers; and arranging a projection (46) to be moved against the wide flaps to at least one of vertically downwardly fold and cut through the holder blank via knives (35) fastened to the projection.

11. The method of packaging together a plurality of containers (6) according to claim 1 further comprising the steps of fabricating the holder blank (4) from corrugated cardboard and forming an even number of individual separate holders in each holder blank, and the individual separate holders are connected to one another via bridges (37) formed by perforations.

12. The method of packaging together a plurality of containers (6) according to claim 11, further comprising the steps of simultaneously folding, via a projection (46), the side flaps (39) into a desired shape and cutting the holder blanks (4) into the individual holders by means of knives (35) fastened to the projection.

13. A device for packaging together a plurality of containers (6), each having a cap (26) and a neck flange (28), via a holder blank (4) comprising foldable side flaps (39) and a plurality of perforations forming flexible fingers defining a plurality of apertures for engaging with one of the plurality of containers, at least some of the flexible fingers being formed integral with and simultaneously movable in a direction opposite to a direction of movement of the foldable side flaps (39), the device comprising:

a separation unit (9) for containing a plurality of stacked holder blanks and sequentially feeding one of the stacked holder blanks from the separation unit (9) to an application unit (3);

a container conveyor for conveying the plurality of containers (6) in a desired arrangement (27) to a position in the application unit vertically below the sequentially fed holder blank;

the application unit (3) having a mechanism for causing relative vertical movement between the fed holder blank and the plurality of containers in the application unit to facilitate folding of the foldable side flaps (39) of the holder blank (4) vertically downward for contacting and at least partially encompassing an adjacent group of the plurality of containers while the flexible fingers, formed integral with the side flaps (39), simultaneously moving in an opposite vertically upward direction, and concurrently urging the holder blank vertically downward to allow each of the apertures to engage one of the plurality of containers in a desired arrangement (27) such that the remaining flexible fingers are biased vertically upward, as a result of contact with the cap and the neck flanges of the containers engaging within the apertures; and the mechanism of the application unit (3), upon further relative vertical movement between the fed holder blank and the plurality of containers, causing the fed holder blank to be moved vertically below at least the caps of the plurality of containers to facilitate the flexible fingers elastically and independently springing into a locking position to captively engage at least one of the cap and neck flange of the plurality of containers.

14. The device according to claim 13, wherein the application unit comprises a multiple function unit (16) for positioning and carrying the fed holder blank (4) by means of positioning pins (36) and opposed horizontal carrying surfaces (18), the multiple function unit substantially simultaneously vertically lowering the fed holder blank (4) into engagement with the plurality of containers (6), cuts the holder blank (4) into a plurality of individual separate holders, and folds the side flaps (39) of the individual holders vertically downward via folding flanges about one adjacent group of containers and concurrently biases the flexible fingers vertically upward to enable a respective cap and neck flange to pass through the aperture until the flexible fingers are allowed to spring into the locking position.

15. The device according to claim 14, wherein each of the individual holder blanks (4) has side flaps (39) defined by discontinuous fold scores (41), the multiple function unit (16) vertically lowers the fed holder blank onto the desired arrangement (27), folds the side flaps (39) vertically downward about the discontinuous fold scores (41) to bias the flexible fingers (44) integral with the side flaps as a rigid unit, and allows movement of a free end edge of the flexible fingers to a level below a lower limitation of the caps and the flanges, in order to subsequently, during a returning upward movement, allow the flexible fingers to elastically and independently spring into the locking position below one of the cap and the neck flange.

16. The device according to claim 14, wherein the multiple function unit (16) further comprises opposing lateral carrying hooks (17) for holding opposing lateral edges of the holder blank, each carrying hook, having on a lower portion thereof, one of the pair of opposed horizontal surfaces for supporting the fed holder blank, and an upper portion of the carrying hooks (17) is rotatably fastened to a pivot (19), the carrying hooks perform simultaneous mutually opposite rotational movements managed via a control arm (20) non-rotatably connected to one pivot, the control arm rotatably influencing a movement transfer arm (21) non-rotatably connected to the other pivot of the opposed carrying hook (17).

17. The device according to claim 16, wherein the device further comprises a horizontal multiple function plate (23) arranged between the opposed horizontal surfaces (18) and the pivots (19) of the carrying hooks (17), the horizontal multiple function plate (23) is fastened to the lower portion of a plurality of columns (24), the columns support the pivots (19) on an upper portion thereof, the plate is replaceable and has a pattern of through holes (25), corresponding to the desired arrangement (27) of the plurality of bottles (27) on the container conveyor (5), and the through holes (25) are designed to align with and be pressed vertically downward over the caps (26) and flanges of the containers (6), and the through holes are provided with one of an upper step and constriction (29) which allows the caps, but not the neck flanges, to pass unobstructed through the through hole.

18. The device according to claim 17, wherein the side flaps of the fed holder blank are folded by the plate and have opposed first and second short sides and opposed first and second long sides, the opposing carrying hooks (17) are arranged to support the holder blank adjacent the two short sides of the plate (23), and folding flanges (30) are attached to and project vertically downward from the plate, along the two long sides of the plate (23), the folding flanges have a width which is a same dimension as a thickness of the plate; and the fed holder blank is aligned on the plate via at least two positioning pins (36) which depend downwardly from the plate, the positioning pins (36) are diagonally disposed, have a cone-shaped tip portion for piercing grip holes (32) in the holder blank (4) and cylindrical bases (33) with a diameter substantially the same as a diameter of the grip hole; and the fed holder blank is cut into a plurality of individual holders via a plurality of knives (35) which depend downwardly from the plate, the knives are aligned above bridges (37) of the fed holder blank and cut through the bridges to separate the holder blank into the individual holders, and each individual holder engages with an adjacent group of containers (6) to produce a complete package of containers.

19. The device according to claim 13, wherein the holder blank (4) is fabricated from corrugated cardboard and forms a plurality of individual holders connected to one another by bridges (37) defined via perforations, and each individual holder having side flaps (39) on at least two mutually opposite sides, the side flaps are separated from a main area (40) of the holder blank (4) by one of a discontinuous perforation and a fold line (41), and two grip holes (32) are formed in the main area of each individual holder.

20. A device for packaging together a plurality of containers (6) having a cap (26) and a neck flange (28), by means of holder blanks (4) comprising foldable side flaps (39) and perforations forming flexible fingers defining a plurality of apertures for engaging the plurality of containers, at least some of the flexible fingers formed integral with and substantially moveable in planer symmetry with the foldable side flaps (39), the device comprising:

a separation unit (9) for compiling a plurality of holder blanks in a stack and feeding a holder blank from the stack compiled in the separation unit (9) to an application unit (3);

the plurality of containers (6) being conveyed in a desired arrangement (27) via a container conveyor to a position in the application unit vertically below the holder blank and the holder blank is applied to the plurality of containers wherein the foldable side flaps (39) of the holder blank (4) are folded downward to contact and at least partially encompass an adjacent group of the plurality of containers, and the holder blank being urged concurrently downward to allow the apertures to engage the plurality of containers wherein the flexible fingers are pressed and turned vertically upward via contact with the cap and neck flanges of the containers engaging within the apertures;

the holder blank being moved further downward to a level at least below the caps to allow the flexible fingers to elastically and independently spring into a locking position to captively engage at least one of the cap and neck flange of the containers;

a horizontal multiple function plate (23) arranged between the opposed horizontal surfaces (18) and the pivots (19) of the carrying hooks (17), the horizontal multiple function plate (23) is fastened to the lower portion of a plurality of columns (24), the columns supporting on an upper portion thereof the pivots (19), the plate is replaceable and has a pattern of vertical, preferably through holes (25), corresponding to the desired arrangement of the plurality of bottles (27) on the container conveyor (5), and are designed to align with and be pressed downward over the caps (26) and flanges of the containers (6) and wherein a flange (28) is formed below the cap (26) on the container, the through holes are provided with one of an upper step and constriction (29), which allows the caps, but not the flanges, to pass unobstructed through the through hole.

* * * * *